US008997852B1

(12) United States Patent
Lee et al.

(10) Patent No.: US 8,997,852 B1
(45) Date of Patent: Apr. 7, 2015

(54) ELECTRICAL SUBMERGIBLE PUMPING SYSTEM USING A POWER CROSSOVER ASSEMBLY FOR A POWER SUPPLY CONNECTED TO A MOTOR

(71) Applicant: Alkhorayef Petroleum Company Limited, Need, VA (US)

(72) Inventors: Woon Yung Lee, Sugar Land, TX (US); Ying Xue, Shanghai (CN)

(73) Assignee: Alkhorayef Petroleum Company Limited, Al Khobar (SA)

( * ) Notice: Subject to any disclaimer, the term of this patent is extended or adjusted under 35 U.S.C. 154(b) by 0 days.

(21) Appl. No.: 14/453,770

(22) Filed: Aug. 7, 2014

(51) Int. Cl.

| | |
|---|---|
| ***E21B 43/00*** | (2006.01) |
| ***E21B 43/12*** | (2006.01) |
| ***E21B 33/129*** | (2006.01) |
| ***F04D 25/06*** | (2006.01) |
| ***F04B 17/03*** | (2006.01) |
| ***F04B 23/02*** | (2006.01) |

(52) U.S. Cl.
CPC ..... *E21B 43/128* (2013.01); *E21B 33/129* (2013.01); *F04D 25/0686* (2013.01); *F04B 17/03* (2013.01); *E21B 43/12* (2013.01); *F04B 23/021* (2013.01)

(58) Field of Classification Search
CPC ..... F04B 23/021; F04B 17/03
USPC ..... 166/66.4, 68, 105–112, 243
See application file for complete search history.

(56) References Cited

U.S. PATENT DOCUMENTS

| | | | | |
|---|---|---|---|---|
| 3,437,149 | A * | 4/1969 | Cugini et al. | 166/379 |
| 4,330,740 | A * | 5/1982 | Shell et al. | 318/780 |
| 4,708,201 | A * | 11/1987 | Reed | 166/65.1 |
| 5,303,773 | A * | 4/1994 | Czernichow et al. | 166/66 |
| 6,116,337 | A * | 9/2000 | Civarolo et al. | 166/65.1 |
| 6,167,965 | B1 * | 1/2001 | Bearden et al. | 166/250.15 |
| 6,397,945 | B1 * | 6/2002 | Manke et al. | 166/65.1 |
| 6,582,251 | B1 * | 6/2003 | Burke et al. | 439/589 |
| 6,834,716 | B2 * | 12/2004 | Uhlenkott | 166/65.1 |
| 7,191,828 | B2 * | 3/2007 | Arizmendi et al. | 166/65.1 |
| 7,264,494 | B2 * | 9/2007 | Kennedy et al. | 439/274 |
| 7,632,124 | B2 * | 12/2009 | Kennedy et al. | 439/274 |
| 7,640,993 | B2 * | 1/2010 | Head | 166/385 |
| 7,726,396 | B2 * | 6/2010 | Briquet et al. | 166/242.6 |
| 7,726,997 | B2 * | 6/2010 | Kennedy et al. | 439/274 |
| 8,042,611 | B2 * | 10/2011 | Briquet et al. | 166/242.6 |
| 8,196,657 | B2 * | 6/2012 | Kennedy | 166/265 |
| 8,240,375 | B2 * | 8/2012 | Briquet et al. | 166/242.6 |
| 8,291,983 | B2 * | 10/2012 | Rooks | 166/369 |
| 8,316,949 | B2 * | 11/2012 | Rooks | 166/369 |
| 8,342,238 | B2 * | 1/2013 | McCoy et al. | 166/105 |
| 8,353,352 | B2 * | 1/2013 | Leitch | 166/369 |
| 8,381,820 | B2 * | 2/2013 | Martinez | 166/369 |
| 2005/0186823 | A1 * | 8/2005 | Ring et al. | 439/322 |
| 2006/0283606 | A1 * | 12/2006 | Partouche et al. | 166/380 |

* cited by examiner

*Primary Examiner* — Blake Michener
(74) *Attorney, Agent, or Firm* — Jones Day

(57) ABSTRACT

An electric submergible pumping system that includes a pump having a pump discharge; a motor; a power crossover assembly including a top flange having a generally circular opening in the center, an upper tubular portion connected to the top flange portion, a lower tubular portion including two generally rectangular-like shaped windows for intake suction for crude oil, a lower flange having a circular shape connected to the lower tubular portion. The top flange, the upper tubular portion, the lower tubular portion, and the lower flange are one unit, each having three adjacent holes passing there through in alignment. A first support leg includes a vertical extension from the lower flange to the upper tubular portion. Three electrical conductors, each disposed adjacent to each other, pass through the three adjacent holes for electrical connection to the motor.

20 Claims, 6 Drawing Sheets

ELECTRICAL SUBMERGIBLE PUMPING SYSTEM USING A POWER CROSSOVER ASSEMBLY FOR A POWER SUPPLY CONNECTED TO A MOTOR

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There have been no joint research agreements entered into with any third parties.

FIELD OF THE INVENTION

The embodiments of the present invention relate generally to an electrical submergible pumping system using a power crossover assembly for a power supply connected to a motor. More specifically, the pumping system is a submergible crude oil pumping system utilized for pumping crude oil from underground sources to oil recovery facilities located on the surface.

BACKGROUND OF THE INVENTION

In submergible crude oil pumping systems, the system's components including the pump, motor, tubing, and related mechanical features are disposed within a well casing in a bore hole typically in or beneath the oil well underground, commonly at distances from 1-2 kilometers under the earth's surface.

It is quite common for some of this equipment to break down during operation, requiring work stoppage and repair, or the introduction of new pumping systems into the bore hole. Engineers and oil service companies are constantly reviewing pumping systems and related operations to improve their efficiency and reliability.

One area of review to improve the efficiency and reliability of the pumping systems is the electrical supply system. The electrical supply for such pumping systems typically includes up to 4 kv power supply, with three separate phases of power being included in one electrical power supply to the pumping system. The electrical power supply has been one of the weakest points of electrical submergible pumping systems. As a result, more failures related to the electrical power supply have been reported during field operations. Due to the environment that these systems operate in, the oil, sand, rock, etc. either degrade the protective covering around the electrical conductor or are sharp enough to break the protective cover's barrier leading to a failure of the electrical supply leading to a motor damage, an explosion, furthermore, breakdown of the whole submergible pumping systems. The electrical system for the motor in the pumping system requires a reasonable space for reliability of connection, insulation, and sealing. In many applications, the down hole space is very limited.

Therefore, there is a need for more efficient and reliable electrical supply to motors associated with the pumping systems.

SUMMARY OF THE INVENTION

An embodiment of the present invention is directed to an electric submergible pumping system that includes a pump having a pump discharge; a motor; a power crossover assembly including a top flange having a generally circular opening in the center, an upper tubular portion connected to the top flange portion, a lower tubular portion including two generally rectangular-like shaped windows for intake suction for production fluids, a lower flange having a circular shape connected to the lower tubular portion. The top flange, the upper tubular portion, the lower tubular portion, and the lower flange are one unit, each having three adjacent holes passing there through in alignment. A first support leg includes a vertical extension from the lower flange to the upper tubular portion and three electrical conductors, each disposed adjacent to each other, pass through the three adjacent holes for electrical connection to the motor.

Another embodiment of the present invention is directed to an electric submergible pumping system that includes a pump having a pump discharge; a motor; a power crossover assembly including a top flange having a generally circular opening in the center, an upper tubular portion connected to the top flange portion, a lower tubular portion including two generally rectangular-like shaped windows for intake suction for production fluids, a lower flange having a circular shape connected to the lower tubular portion. The top flange, the upper tubular portion, the lower tubular portion, and the lower flange are one unit, each having three adjacent holes passing there through in alignment. A first support leg includes a vertical extension from the lower flange to the upper tubular portion and a second support leg is generally disposed opposite the first support leg for balancing the power crossover assembly on the motor. Three electrical conductors, each disposed adjacent to each other, pass through the three adjacent holes for electrical connection to the motor.

In yet another embodiment of the present invention, an electric submergible pumping system includes a pump having a pump discharge; a motor; a power crossover assembly including a top flange having a generally circular opening in the center, an upper tubular portion connected to the top flange portion, a lower tubular portion including two generally rectangular-like shaped windows for intake suction for production fluids, a lower flange having a circular shape connected to the lower tubular portion. The top flange, the upper tubular portion, the lower tubular portion, and the lower flange are one unit, each having three adjacent holes passing there through in alignment. A first support leg includes a vertical extension from the lower flange to the upper tubular portion and a second support leg is generally disposed opposite the first support leg for balancing the power crossover assembly on the motor. Three electrical conductors, each disposed adjacent to each other, pass through the three adjacent holes for electrical connection to the motor. This embodiment further includes the inlet and production tubing. In addition, this embodiment includes the at least two inlet openings disposed between the first support leg and second support leg, where each of the inlet openings are radially about 110 degrees wide.

DETAILED DESCRIPTION OF THE EMBODIMENTS OF THE PRESENT INVENTION

Figure 1:
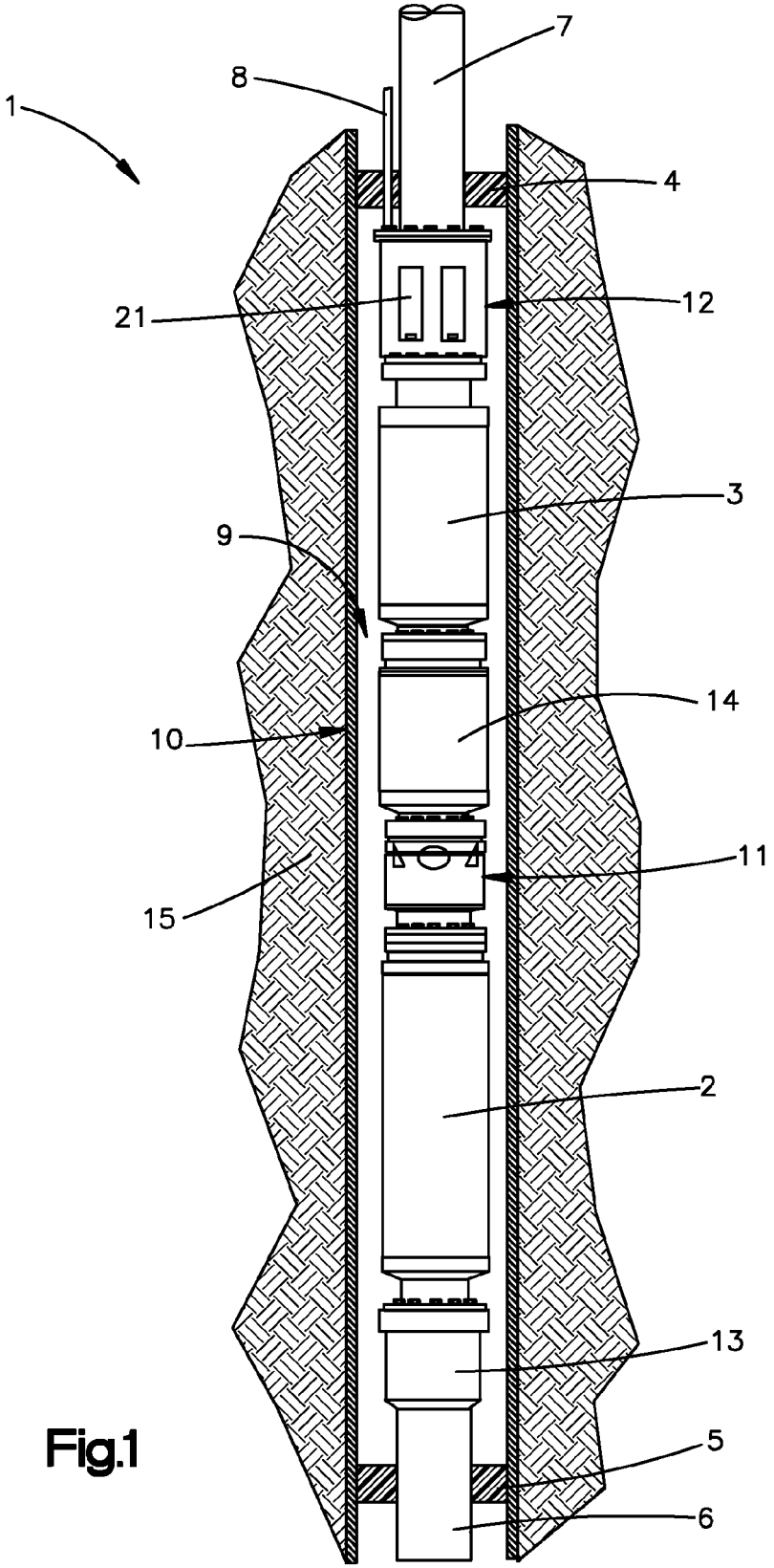
FIG. 1 shows an electric submergible pumping system according to an embodiment of the present invention. The pumping system includes inlet tubing, pump, pump discharge, motor and motor protector, power crossover assembly, electrical conductor, production tubing, and upper and lower packer assemblies, all within a wellbore in a geological formation.

The embodiments of the present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will enable a person of ordinary skill in the art to make and use the invention.

In the following description, like reference characters designate like or corresponding parts throughout the figures. Additionally, in the following description, it is understood that terms such as "top," "bottom," "side," "front," "back," "inner," "outer," and the like, are words of convenience and are not to be construed as limiting terms.

FIG. 1 shows an electric submergible pumping system according to an embodiment of the present invention. The pumping system includes inlet tubing 6, pump 2, pump discharge 11, motor 3 and motor protector 14, power crossover assembly 12, electrical conductor 8 typically in the range of 2-4 kv, production tubing 7, and upper 4 and lower 5 packing assemblies, all within a wellbore 9 in a geological formation 15. As shown on FIG. 1, the upper 4 and lower 5 packer assemblies create a sealed environment inside the wellbore casing 10 to prevent any contaminants from getting inside therein and adversely affecting the pumping systems performance. These packer assemblies are known in the art and generally include slip, cone, packing-element system, and body of mandrel. A variety of conventional packer assemblies known in the art can be adapted for use with this submergible pumping system. (See http://petrowiki.org/Packers for other assemblies, all of which are incorporated herein by reference.)

Referring generally to FIG. 1, an inverted electric submergible pumping system 1 is illustrated according to a preferred embodiment of the present invention. The embodiments of the present invention are not limited to "inverted" pumping systems but the system shown in FIG. 1 depicts such an "inverted" embodiment. A person of ordinary skill in the art will readily understand that in inverted pumping systems, the pump is disposed at the lower end of the system; the motor is disposed at the upper end. In more common pumping systems, the motor is disposed at the bottom of a pump and the tubing lines are connected to the pump's discharge.

A submergible pumping system 1 as shown in FIG. 1 may include a variety of components depending on the particular application or environment in which it is used. However, a preferred embodiment of a submergible pumping system 1 typically includes a pump 2, a motor 3, an upper packer assembly 4, and a lower packer assembly 5. Lower packer assembly 5 is preferably deployed at the bottom of submergible pumping system 1 along with the intake tubing 6. The upper packer system 4 is preferably deployed at the top of system 1 with the production tubing 7 and electrical conductor 8. Intake tubing 6 and production tubing 7 may be, for example, conventional production tubing known in the art as provided below suitable for conducting a fluid such as crude oil there through. Based on the size of wellbore casing and the diameter of electrical submergible pumping system, proper tubing can be selected from API standard sizes as provided below.

| Tubing# | OD | ID |
|---|---|---|
| 2⅜ in LP, 3.75 #/ft | 2.375 | 2.067 |
| 2⅜ in NU, 4 #/ft | 2.375 | 2.041 |
| 2⅜ in EU, 4.7 #/ft | 2.375 | 1.995 |
| 2⅞ in NU, 6.4 #/ft | 2.875 | 2.441 |
| 2⅞ in EU, 6.5 #/ft | 2.875 | 2.441 |
| 3½ in LP, 7.7 #/ft | 3.5 | 3.068 |
| 3½ in NU, 7.7 #/ft | 3.5 | 3.068 |
| 3½ in EU, 9.3 #/ft | 3.5 | 2.992 |
| 3½ in LP, 11.7 #/ft | 4.5 | 4.026 |
| 4 in NU, 9.5 #/ft | 4 | 3.548 |
| 4 in EU, 11.0 #/ft | 4 | 3.476 |
| 4½ in NU, 12.6 #/ft | 4.5 | 3.958 |
| 4½ in EU, 12.75 #/ft | 4.5 | 3.958 |

-continued

| Tubing# | OD | ID |
|---|---|---|
| 6⅝ in LP, 19.45 #/ft | 6.625 | 6.065 |
| 8⅝ in LP, 25.55 #/ft | 8.625 | 8.071 |

A person of ordinary skill in the art will readily understand that the size of the casings may vary but may include 4 inch, 5 inch, 7 inch, 9 inch, and other known in the art sizes for casings. The casing shields the system components from the external environment but the casing is full of crude oil, that is, all the components are preferably completely submerged in crude oil, and the crude oil is pumped to the surface using an embodiment of the pump systems described herein. In addition, from packer to packer assembly, the length of a system may vary based on system needs but may include about 100 feet.

As understood by a person of ordinary skill in the art, a length of single unit pump is preferably up to 20 feet. A length of a single unit motor protector is preferably up to 11 feet. A length of a single unit motor is preferably up to 30 feet. Based on the depth of the well, a pump unit can be double units or triple units. Based on the power requirements for the pump, the motor can be double units or triple units. Assuming the lengths above are used, a preferred maximum combined size of single units could be 61 feet (20+11+30). If double pumps and triple motors are used, the total length of a submergible pumping system may be 141 feet (20+20+11+30+30+30).

As understood by a person of ordinary skill in the art, the pump discharge pressure will be determined by the depth of pump location (pressure=depth feet/2.31). The pump length (number of pump stages) can be calculated based on the total pressure requirement divided by the pressure per each pump stage. For example, if the well depth is 3,000 ft, the pump discharge pressure should be more than 3,000/2.31=1,299 psi.

As illustrated in FIG. 1, an embodiment of the submergible pumping system 1 is designed for deployment in a well 9 within a geological formation 15 containing desirable production fluids, such as crude oil. In a typical application, a wellbore 9 is drilled in a geological formation 15 and lined with a wellbore casing 10. The submergible pumping system 1 is then deployed within the wellbore 9 to a desired location for retrieval of fluids. At a location below the oil field, the submergible pumping system 1 and lower packer assembly 5 is preferably set and sealed against an interior surface of the wellbore casing 10. A person of ordinary skill in the art will readily understand that a "submergible pumping system" means a pumping system capable of being immersed in, or being disposed under, a fluid body, in the preferred embodiment described herein, the fluid body is crude oil. The production fluids may then be pumped from the well through intake tubing 6, powered by motor 3, to a point above lower packer assembly 5 and discharged through pump discharge 11 into the annulus formed between the submergible pumping system 1 and an interior surface of wellbore casing 10. The discharged fluid to the annulus above the lower packer assembly 5 is continually moved up to the power crossover assembly 12 below the upper packer assembly 4, the production fluid enters the opening of the power crossover assembly 12 and continues to move through production tubing 7 to a point at or above the earth's surface where the production fluid is collected for further processing.

As illustrated in FIG. 1, an embodiment of the submergible pumping system 1 typically includes additional components, such as a pump intake 13, through which wellbore fluids enter the pump 2 and a motor protector 14 that serves to isolate the well fluid from the motor oil. Additionally, a power crossover assembly 12 is used to connect the submergible pumping system 1 with a deployment system, such as production tubing 7 and electrical conductor 8. In a preferred embodiment, the deployment system is a conventional production tubing system 7 and an electrical conductor 8 running inside of the wellbore casing 10 along with the production tubing 7.

A variety of motors 3 and pumps 2 can be used in submergible pumping systems 1. A preferred motor 3 includes a three-phase, induction-type motor or a permanent magnet type motor, and a preferred pump 2 includes a multi-staged centrifugal pump. Additionally, other components can be added, removed, or the sequence of components can be rearranged according to a desired application.

Figure 2:
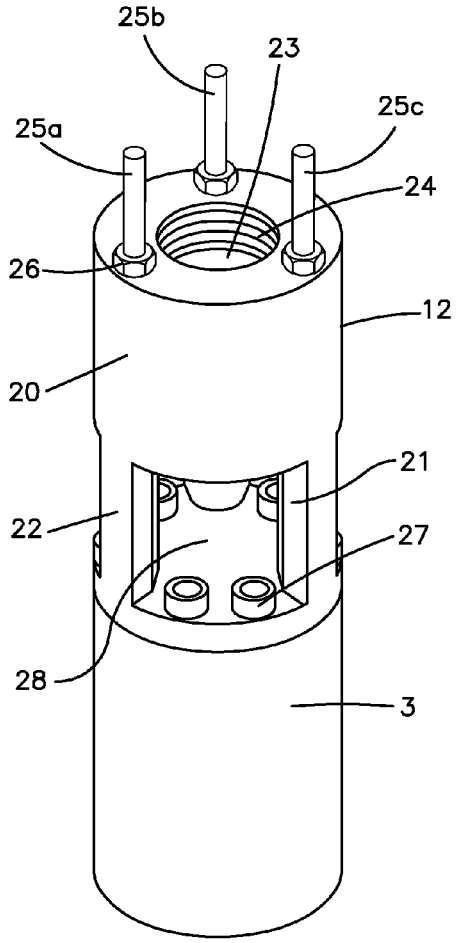
FIG. 2 shows a view of a power crossover assembly according to an embodiment of the present invention, the embodiment including at least three electrical conductor support legs and three electrical conductors arranged in a pyramid configuration when viewed from the top of the crossover assembly, with the power crossover assembly attached to a motor head.

FIG. 2 shows a view of a power crossover assembly 12 according to an embodiment of the present invention, the embodiment including at least three electrical conductor support legs 22 and three electrical conductors 25*a*, 25*b*, 25*c* arranged in a pyramid configuration when viewed from the top of the crossover assembly 12, and with the power crossover assembly 12 attached to a motor 3 head.

Referring generally to FIG. 2, a three-dimensional view of a power crossover assembly 12 is illustrated. In the body 20 of the crossover 12, functionally the production fluid flows upward and electrical power flows downward. In the preferred embodiment, the crossover assembly 12 includes a body 20 that has three inlet openings 21 (only one inlet opening is shown in FIG. 2) and three legs 22 (only two legs are shown in FIG. 2). Production fluids/crude oil enters the inlet opening 21 preferably between two legs 22. As shown in FIG. 2, the inlet opening 21 has a generally square-shaped opening, for example, radially 90 degrees wide (preferably 2.7 inch circular length), and preferably 2.5 inches high for 3.5 inch diameter equipment; a person of ordinary skill in the art will readily understand that the size and shapes of the inlet openings may vary based on system needs. After entering the inlet openings 21, the production fluid flows directly to the top of the body 20. The top of the crossover body 20 has a hole 23 that serves as an outlet to production tubing 7 as shown in FIG. 1, where the hole 23 includes a threaded inner wall 24 to fit the production tubing 7 male connections (not shown). Production fluid is then directed to the production tubing 7 shown in FIG. 1.

Figure 3:
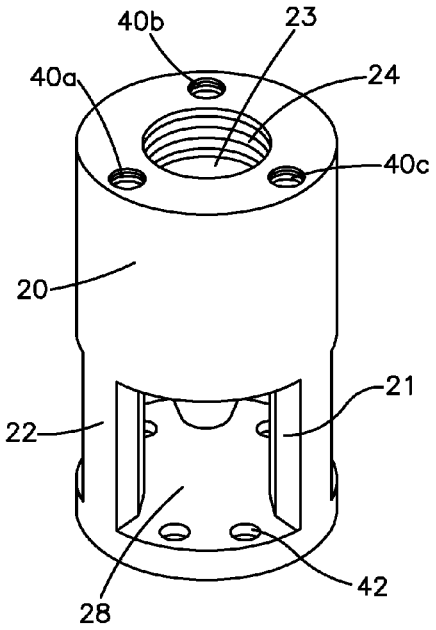
FIG. 3 shows a view of a power crossover assembly according to an embodiment of the present invention, the embodiment including at least three electrical conductor holes for the three electrical conductors, the three holes arranged in a pyramid configuration when viewed from the top of the crossover assembly, and a blind bottom flange connection capable of being attached to a motor head (not shown).

At least three holes (as shown in FIG. 3) are included at the top of the body 20. These three holes continue to the bottom of the crossover body 20, preferably open to the top of the motor 3. Each hole preferably receives one phase of a three-phase conductor 25*a*, 25*b*, 25*c*. Three phase electrical conductors 25*a*, 25*b*, 25*c* pass through the three holes of crossover body 20 and are connected to the motor 3 electrical terminal by a proper connection mechanism known to a person of ordinary skill in the art. The electrical conductors 25*a*, 25*b*, 25*c* are fixed and sealed by a compression nut 26 known in the art at the top of the crossover body 20.

A preferred embodiment of the crossover assembly 12 as shown in FIG. 2 includes a lower mounting structure connected to the next sequential component, preferably the motor 3, of the pumping system 1. The lower mounting structure may be designed for connection to the motor 3 and the crossover body 12 via a plurality of fasteners, such as bolts 27; bolt holes 42 are shown in FIG. 3. A blind bottom plate 28 preferably separates the motor 3 from the crossover assembly 12.

In the preferred embodiment shown in FIG. 2, the electrical conductor 8 shown in FIG. 1 preferably comes with three separate electrical conductors 25*a*, 25*b*, 25*c*. Each of three electrical conductors 25*a*, 25*b*, 25*c* is substantially equally spaced radially outward from the center and runs through the hole of crossover body 20. Each of the electrical conductors 25*a*, 25*b*, 25*c* may be sheathed in an outer insulative layer. The insulative layer is preferably surrounded by an armor layer, such as metallic tubing, for added strength and protection. As shown in FIG. 2, the three electrical conductors 25*a*, 25*b*, 25*c* are preferably spaced equidistant from each other, in a pyramid-like arrangement when a person of ordinary skill in the art views same from a top perspective.

More specifically, FIG. 2 includes an upper cylindrical flange having a circular opening generally disposed in the center of the flange. The circular opening includes an outlet 23 to production tubing 7 and known in the art threading 24 for a male connection associated with the production tubing 7. The electrical conductor power supply is referred to herein as a tripartite power supply as it means three separate electrical conductors 25*a*, 25*b*, 25*c* disposed in different sections of the crossover assembly 12 and more specifically, each of the three electrical conductors 25*a*, 25*b*, 25*c* has its own protective leg 22 that includes a "shell-like" structure preferably completely covering each of the electrical conductors and therefore, minimizing any opportunities for dirt, sand, oil, fuel, to get therein to damage the electrical supply or to impinge each of the electrical conductors protective barrier. Viewed from above, a person of ordinary skill in the art will appreciate that the tripartite electrical supply includes a pyramid-like shape, with each traversing/running through the crossover body 20 and supporting legs 22 for electrical connection to the motor 3. The electrical conductors 25*a*, 25*b*, 25*c* are secured to the flange of the crossover assembly 12 by known in the art fastening means including compression nuts 26 as shown in FIG. 1.

FIG. 3 shows a view of a power crossover assembly 12 according to an embodiment of the present invention as shown in FIG. 2, the embodiment including at least three electrical conductor holes 40*a*, 40*b*, 40*c* for the three electrical conductors 25*a*, 25*b*, 25*c*, the three holes arranged 40*a*, 40*b*, 40*c* in a pyramid configuration when viewed from the top of the crossover assembly 12, and a blind bottom flange 28 connection capable of being attached to a motor head (not shown). Referring generally to FIG. 3, two supporting legs 22 are disposed instead of three legs 22 described above with respect to the embodiment shown in FIG. 2. As noted above, the inlet openings 21 include generally square-like openings that serve as the suction entry points for the production fluids, e.g., crude oil.

Figure 4:
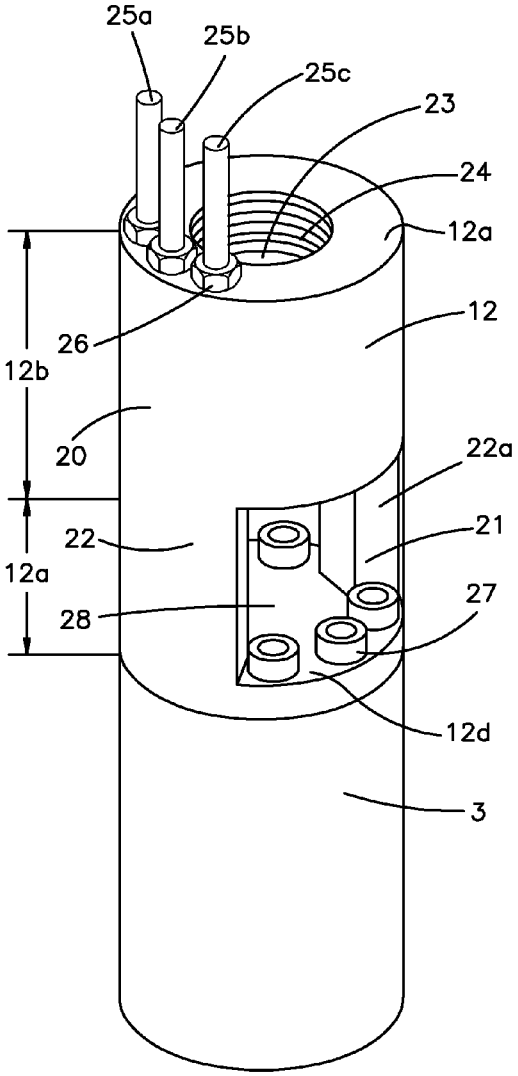
FIG. 4 shows a view of a power crossover assembly according to another embodiment of the present invention, the embodiment including at least three electrical conductors, each disposed adjacent to each other and traversing through a protective crossover body for electrical connection to a motor's head, the embodiment including at least two inlet openings for intake suction and one support leg to balance the crossover assembly on the motor head.

FIG. 4 shows a view of a power crossover assembly 12 according to another embodiment of the present invention, the embodiment including at least three electrical conductors 25*a*, 25*b*, 25*c*, each disposed adjacent to each other and traversing through a protective crossover body 20 for electrical connection to a motor's 3 head, the embodiment including at least two inlet openings 21 for intake suction and one support leg 22*a* to balance the crossover assembly on the motor head.

As shown in FIG. 4, one support leg 22 is preferably wide enough to have three holes for three electrical conductors 25*a*, 25*b*, 25*c* to traverse/pass through. The wide leg 22 functions as a protector for the electrical conductors 25*a*, 25*b*, 25*c* in case any abrasive or corrosive element exists in the production fluid. Another supporting leg 22*a* is disposed at the generally opposite side of the wide supporting leg 22 for balancing; as shown in FIG. 4, none of the electrical conductors 25*a*, 25*b*, 25*c* traverse/pass through this support leg 22*a*. However, this leg can have a hole for any other purpose, such as a sensor wire. For the embodiment shown in FIG. 4, two inlet openings 21 are formed between the two supporting legs 22, 22*a*. Unlike the embodiment shown in FIGS. 2 and 3 showing three inlet openings have a square-like shape, FIG. 4 includes two generally rectangular-like shaped openings, for example, preferably radially 110 degrees wide (preferably 3.4 inch circular length), and preferably 2.5 inches high for 3.5 inch diameter equipment. As shown in FIG. 4, the area of above the inlet openings 21 and support leg 22*a* includes a cylindrical body representing the top portion of the power crossover assembly 12. Motor mounting fasteners, such as bolt assemblies 27 are positioned radially outward of the blind bottom 28.

As further shown in FIGS. 1 and 4, and recited in the claims, an embodiment of the present invention includes an electric submergible pumping system that includes a pump 2 having a pump discharge, a motor 3, and a power crossover assembly. The power crossover assembly 12 includes a top flange 12*a* having a generally circular opening 23 in the center, a generally upper tubular portion 12*b* connected to the top flange portion 12*a*, a lower tubular portion 12*c* including two generally rectangular-like shaped windows 21 for intake suction for production fluids, a lower flange 12*d* having a circular shape connected to the lower tubular portion 12*c*. As shown in FIG. 4, the top flange 12*a*, the upper tubular portion 12*b*, the lower tubular portion 12*c*, and the lower flange 12*d* are preferably one unit, each having three adjacent holes passing there through in alignment from the top flange 12*a* to the bottom flange 12*d*. The first support leg 22 includes a vertical extension from the lower flange to the upper tubular portion. FIG. 4 shows the three electrical conductors, each disposed adjacent to each other and passing through the three adjacent holes for electrical connection to the motor.

Figure 5:
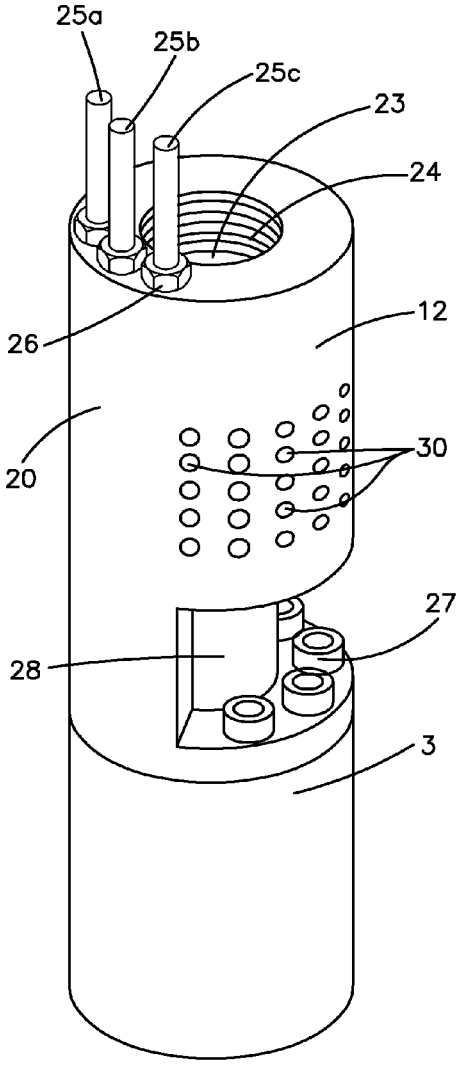
FIG. 5 shows a view of a power crossover assembly according to another embodiment of the present invention, the embodiment including at least three electrical conductors, each disposed adjacent to each other and traversing through a protective crossover body for electrical connection to a motor's head, the embodiment including a plurality of perforated holes on an exterior surface of the crossover assembly for intake suction and a vertically extended cylindrical body serving as the blind bottom between the crossover assembly and motor.

FIG. 5 shows a view of a power crossover assembly 12 according to another embodiment of the present invention, the embodiment including at least three electrical conductors 25*a*, 25*b*, 25*c*, each disposed adjacent to one other and traversing through a protective crossover body 20 for electrical connection to a motor's 3 head, the embodiment including a plurality of perforated holes 30 disposed on an exterior surface of the top portion of the crossover assembly 12 for intake suction.

In the embodiment illustrated in FIG. 5, the blind bottom 28 includes a vertically extended cylindrical body extended to an elevated position between the crossover assembly 12 and motor 3. The inlet opening 21 shown in FIGS. 1-4 is located at an upper section of crossover body 12. However, in this embodiment, the inlet openings 21 shown in FIGS. 1-4 are replaced by a plurality of perforated holes 30 to serve as the intake for the production fluid. Each perforated hole is preferably 0.25 inch diameter and the center of each hole is preferably 0.5 inch apart; the number and size of the perforated holes may vary based on system needs. The area of the body 20 that the electrical conductors 25*a*, 25*b*, 25*c* pass through includes holes (not shown) to prevent any damage from the abrasive or corrosive composition of the production fluid. As shown in FIG. 5, three electrical conductors 25*a*, 25*b*, 25*c* are located radially at the same side of top surface of crossover body 20, with each of the three electrical conductors 25*a*, 25*b*, 25*c* being disposed adjacent to each other. The conductors 25*a*, 25*b*, 25*c* are preferably fixed and sealed at the top of hole by a proper fastener, such as a compression nut 26. The lower side of the power crossover assembly 12 includes a mounting structure by which it is connected to the next sequential component, preferably motor 3, of the pumping system 1. The mounting structure may be designed for connection to motor 3 and crossover body 12 via a plurality of fasteners, such as bolts 27.

Figure 6A:
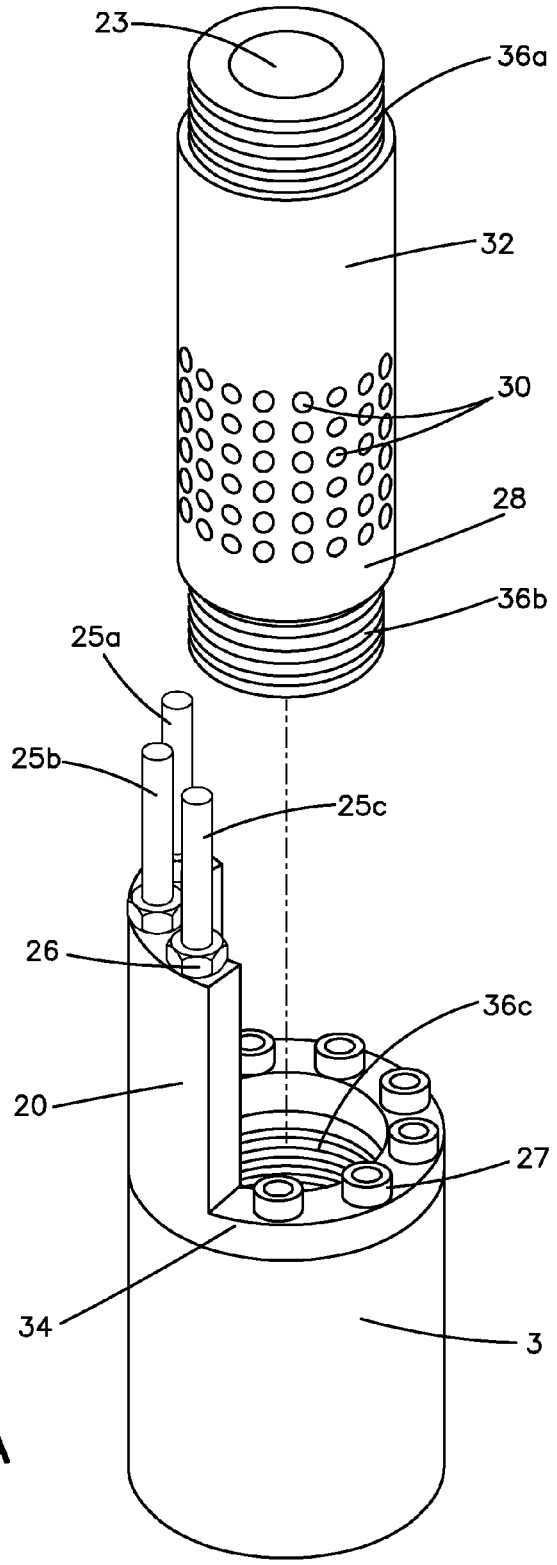
FIGS. 6A and 6B show views of a power crossover assembly according to another embodiment of the present invention, with FIG. 6A showing a cylindrical tubing intake with a plurality of perforated holes on an exterior surface of the intake separate from the crossover assembly, and with FIG. 6B showing a cylindrical tubing intake with a plurality of perforated holes on an exterior surface of the intake connected to the crossover assembly, the embodiment including at least three electrical conductors, each disposed adjacent to each other and traversing through a protective crossover body for electrical connection to a motor's head.
Figure 6B:
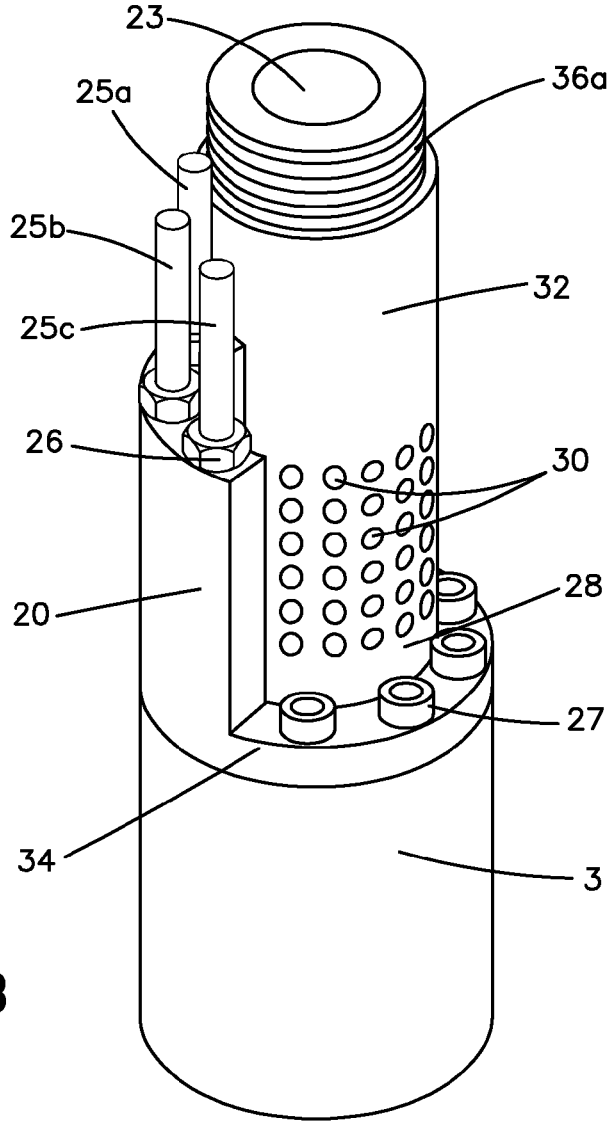

FIGS. 6A and 6B show views of a power crossover assembly 12 according to another embodiment of the present invention, with FIG. 6A showing a cylindrical tubing intake 32 with a plurality of perforated holes 30 on an exterior surface of the intake 32 separate from the crossover assembly, and with FIG. 6B showing a cylindrical tubing intake 32 with a plurality of perforated holes 30 on an exterior surface of the intake connected to the crossover assembly, the embodiment including at least three electrical conductors 25*a*, 25*b*, 25*c*, each disposed adjacent to each other and traversing through a protective crossover body 12 for electrical connection to a motor's 3 head.

In the embodiment illustrated in FIGS. 6A and 6B, the protecting crossover body 20 for the electrical conductors 25*a*, 25*b*, 25*c* and body of tubing intake 32 are separated into two bodies as shown in FIG. 6A, which are connected by the proper thread mechanism 36*a*, 36*b*. The protective crossover body 20, when viewed by a person of ordinary skill in the art from above, includes a support structure having a shape in the form of a vertical wall having coverage from approximately a 6-9 o'clock perspective, connected (preferably permanently to form one unit) to a complete 360 circular flange portion at the bottom thereof with openings for bolt assemblies 27 for connection to the top of the motor 3. FIG. 6B shows the protecting crossover body 20 for the electrical conductors 25*a*, 25*b*, 25*c* and body of tubing intake 32 connected to form one unit.

The protecting crossover body 20 shown in FIGS. 6A and 6B include the vertical wall, protecting part of electrical conductors 25*a*, 25*b*, 25*c* and horizontal flange part 34 that attaches to the motor 3 head. Holes (not shown) for three electrical conductors 25*a*, 25*b*, 25*c* are located radially at the same side of top surface, with each hole being relatively adjacent to each other. Three holes continue to the bottom of the crossover body 20 open to the top of the motor 3. Each hole receives one of the three-phase conductors 25*a*, 25*b*, 25*c*. Three phase power conductors 25*a*, 25*b*, 25*c* go through the three holes of the crossover body 20 and are preferably connected to the motor 3 electrical terminal by a proper connection mechanism known in the art and understood by a person of ordinary skill in the art. The conductors 25*a*, 25*b*, 25*c* are fixed and sealed by a proper fastener, such as a compression nut 26.

The bottom portion of the intake tubing is blocked by a blind bottom (not shown). The lower thread 36*b* of the intake tubing 32 is used to connect to the matching threaded 36*c* hole of the motor 3 head. The upper thread 36*a* is used to connect to the production tubing 7 via a coupling (not shown but known in the art). A plurality of perforated holes 30 disposed on the surface of the intake tube 32 is the inlet for production fluid to enter. Each perforated hole 30 is open to the space at the center of the tubing intake 32. Each hole is preferably 0.25 inch diameter and the center of each of the holes is preferably 0.5 inch apart. The space at the center of the tubing intake 32 continues to the top of the tubing intake 32 to connect to the production tubing 7 via coupling.

Figure 7:
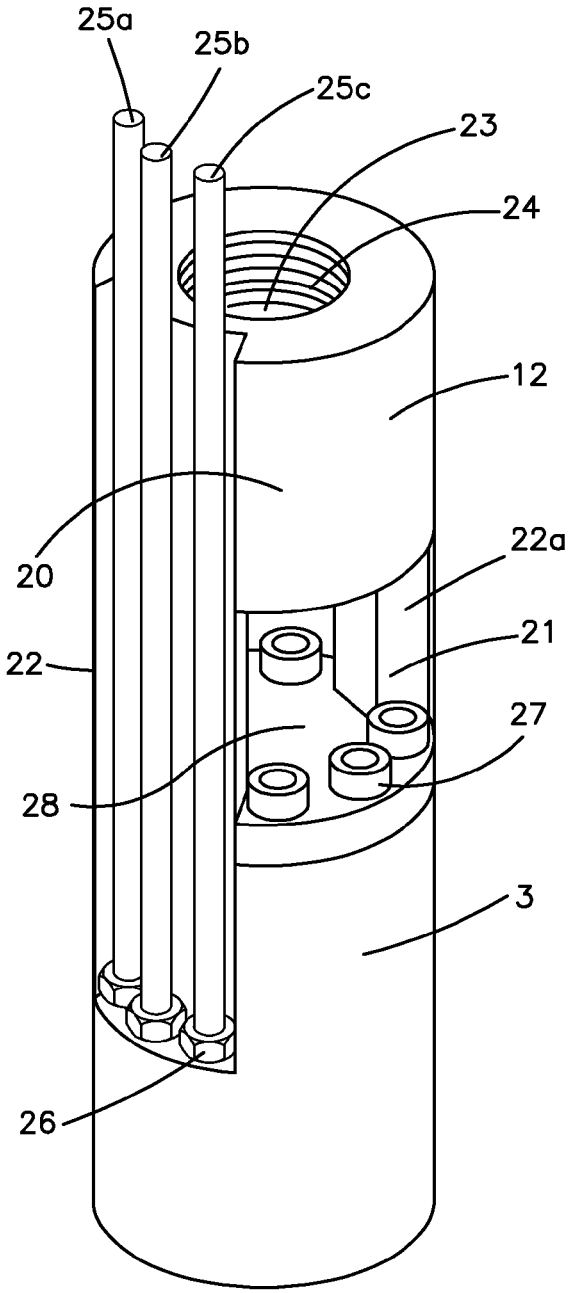
FIG. 7 shows a view of a power crossover assembly according to another embodiment of the present invention, the embodiment including at least three electrical conductors each disposed adjacent to each other and traversing through a channel portion of the protective crossover body, the channel portion being formed in an exterior portion of the protective crossover body for electrical connection to a motor's head, the embodiment including at least two inlet openings for intake suction and one support leg to balance the crossover assembly on the motor head.

FIG. 7 shows a view of a power crossover assembly 12 according to another embodiment of the present invention, the embodiment including at least three electrical conductors 25*a*, 25*b*, 25*c*, each disposed adjacent to each other and traversing through a protective crossover body 20 for electrical connection to a motor's 3 head, the embodiment including at least two inlet openings 21 for intake suction and one support leg 22*a* to balance the crossover assembly on the motor head.

As shown in FIG. 7, one support leg 22 is preferably wide enough to have a channel 22 to hold three electrical conductors 25*a*, 25*b*, 25*c*. The channel 22 is part of the exterior portion of the power crossover assembly and motor, the channel 22 being preferably rectangular in shape and having a depth preferably deep enough to allow the electrical conductors 25*a*, 25*b*, 25*c* traverse, preferably in such a way that the exterior surface of the electrical conductors extend as far as or inside of the exterior surface of the power crossover assembly 12 and motor 3. As shown on FIG. 7, electrical conductors do enter a portion of the motor assembly for connection thereto. The tubular portion of the motor 3 under the rectangular shaped channel 22 functions as a protector for the electrical conductors 25*a*, 25*b*, 25*c* in case any abrasive or corrosive element exists in the production fluid. Another supporting leg 22*a* is disposed at the generally opposite the channel for balancing; as shown in FIG. 7, none of the electrical conductors 25*a*, 25*b*, 25*c* traverse/pass through this support leg 22*a*. However, this leg 22*a* can have a hole for any other purpose, such as for a sensor wire. For the embodiment shown in FIG. 7, two inlet openings 21 are formed between the two supporting legs 22, 22*a*. Unlike the embodiment shown in FIGS. 2 and 3 showing three inlet openings have a square-like shape, FIG. 7 includes two generally rectangular-like shaped openings, for example, preferably radially 110 degrees wide (preferably 3.4 inches circular length), and preferably 2.5 inches high for 3.5 inch diameter equipment. Motor mounting fasteners, such as bolt assemblies 27, are positioned radially outward of the blind bottom 28.

We claim:

1. An electric submergible pumping system comprising:

a pump having a pump discharge;

a motor;

a power crossover assembly including:

a top flange having a generally circular opening in the center, an upper tubular portion connected to the top flange portion, a lower tubular portion including two generally rectangular shaped windows for intake suction for production fluids, a lower flange having a circular shape connected to the lower tubular portion, wherein the top flange, the upper tubular portion, the lower tubular portion, and the lower flange are a single unitary intermediate element, each having three adjacent holes passing there through in alignment, a first support leg including a vertical extension from the lower flange to the upper tubular portion; and at least three electrical conductors, each disposed adjacent to each other and passing through the three adjacent holes for electrical connection to the motor.

2. The system according to claim 1, further comprising an intake tubing and a production tubing, wherein the generally circular opening in the center of the top flange is threaded to receive a male fitting from the production tubing, wherein the vertical extension includes the three adjacent holes.

3. The system according to claim 1, wherein the motor is disposed above the pump in the system, and wherein the production fluids include crude oil.

4. The system according to claim 1, further comprising an upper and a lower packing assembly.

5. The system according to claim 4, wherein the upper and lower packing assembly include a slip, a cone, a packing-element system, and a body of mandrel.

6. The system according to claim 5, wherein the lower packer assembly is deployed at the bottom of the submergible pumping system adjacent to an intake tubing.

7. The system according to claim 5, wherein the upper packer system is deployed at the top of the system adjacent to the production tubing.

8. The system according to claim 1, wherein the motor includes a three-phase, induction motor or a permanent magnet motor.

9. The system according to claim 1, wherein the pump includes a multi-staged centrifugal pump.

10. The system according to claim 1, wherein the power crossover assembly further comprises a second support leg for balancing the power crossover assembly on the motor.

11. The system according to claim 10, wherein the at least one support leg is disposed generally opposite the second support leg.

12. The system according to claim 11, wherein an at least two intake windows are disposed between the two support legs.

13. The system according to claim 1, wherein each of an intake window is radially about 110 degrees wide.

14. The system according to claim 1, wherein a motor mounting fastener includes bolts that mount the power crossover assembly to the top of the motor.

15. An electric submergible pumping system comprising:

a pump having a pump discharge;

a motor;

a power crossover assembly including:

a top flange having a generally circular opening in the center, an upper tubular portion connected to the top flange portion, a lower tubular portion including two generally rectangular shaped windows for intake suction for production fluids, a lower flange having a circular shape connected to the lower tubular portion, wherein the top flange, the upper tubular portion, the lower tubular portion, and the lower flange are a single unitary intermediate element, each having at least three adjacent holes passing there through in alignment, a first support leg including a vertical extension from the lower flange to the upper tubular portion; and a second support leg generally disposed opposite the first support leg for balancing the power crossover assembly on the motor; and at least three electrical conductors, each disposed adjacent to each other and passing through the three adjacent holes for electrical connection to the motor.

16. The system according to claim 15, further comprising: an intake tubing and a production tubing; an upper and a lower packing assembly, wherein the upper and the lower packing assembly include a slip, a cone, a packing-element system, and a body of mandrel.

17. The system according to claim 15, wherein the motor includes a three-phase, an induction motor or a permanent magnet motor, wherein the pump includes a multi-staged centrifugal pump.

18. The system according to claim 15, wherein an at least two intake windows are disposed between the first support leg and the second support leg.

19. The system according to claim 15, wherein each of the intake windows are radially about 110 degrees wide, wherein a motor mounting fastener includes a bolt that mounts the power crossover assembly to the top of the motor.

20. An electric submergible pumping system comprising:

an intake tubing;

a pump having a pump discharge;

a motor;

a power crossover assembly including:

a top flange having a generally circular opening in the center, an upper tubular portion connected to the top flange portion, a lower tubular portion including at least two generally rectangular shaped windows for intake suction for production fluids, a lower flange having a circular shape connected to the lower tubular portion, wherein the top flange, the upper tubular portion, the lower tubular portion, and the lower flange are a single unitary intermediate element, each having at least three adjacent holes passing there through in alignment, a first support leg including a vertical extension from the lower flange to the upper tubular portion; and a second support leg generally disposed opposite the first support leg for balancing the power crossover assembly on the motor;

a production tubing; and at least three electrical conductors, each disposed adjacent to each other and passing through the three adjacent holes for electrical connection to the motor, wherein the at least two intake windows are disposed between the first support leg and the second support leg, and wherein each of the intake windows is radially about 110 degrees wide.

* * * * *